US006766911B2

(12) United States Patent
Higgins

(10) Patent No.: US 6,766,911 B2
(45) Date of Patent: Jul. 27, 2004

(54) LABEL ORIENTING MERCHANDISING DISPLAY DEVICE AND BOTTLE

(75) Inventor: Mark A. Higgins, Duluth, GA (US)

(73) Assignee: Display Industries, LLC., Norcorss, GA (US)

( * ) Notice: Subject to any disclaimer, the term of this patent is extended or adjusted under 35 U.S.C. 154(b) by 68 days.

(21) Appl. No.: 10/298,963

(22) Filed: Nov. 18, 2002

(65) Prior Publication Data

US 2004/0094493 A1 May 20, 2004

(51) Int. Cl.[7] ..... A47F 7/28; A47B 73/00

(52) U.S. Cl. ..... 211/59.2; 211/74; 211/94.01; 248/224.61

(58) Field of Search ..... 211/59.2, 74; 248/224.51, 248/224.61

(56) References Cited

U.S. PATENT DOCUMENTS

| | | | | | |
|---|---|---|---|---|---|
| 3,365,068 | A | * | 1/1968 | Crosby | 211/74 |
| 4,101,042 | A | * | 7/1978 | Strong et al. | 206/806 |
| 5,586,665 | A | * | 12/1996 | Brousseau | 211/59.2 |
| 5,718,341 | A | * | 2/1998 | Robertson | 211/59.2 |
| 5,779,068 | A | * | 7/1998 | Whiten et al. | 211/59.2 |
| D483,201 | S | * | 12/2003 | Berish et al. | D6/450 |

* cited by examiner

*Primary Examiner*—Peter M. Cuomo
*Assistant Examiner*—Erica B. Harris
(74) *Attorney, Agent, or Firm*—John L. James

(57) ABSTRACT

A display rack and bottle are provided with one defining a keyway and the other defining a key. When the key is in the keyway, the bottle label faces forward. Removing a bottle does not alter the relationship between the key and keyway ensuring that the bottle labels always face forward.

1 Claim, 2 Drawing Sheets

LABEL ORIENTING MERCHANDISING DISPLAY DEVICE AND BOTTLE

TECHNICAL FIELD OF THE INVENTION

The present invention relates generally to a merchandising display device for displaying beverage bottles and dispensing the bottles one at a time, and, more particularly, to a device for orienting the bottles so that bottle labels face forward.

BACKGROUND OF THE INVENTION

Display racks are used to hold merchandise awaiting purchase by a consumer. Some items, such as beverages, are best when consumed chilled, and are consequently housed in a refrigerator unit. Display racks are used in the refrigerator to hold beverage containers upright for easy viewing and to dispense them one at a time. Beverages are removed one at a time from the front of the rack and the remaining inventory is urged to the front of the rack for easy removal.

Presentation of the beverage is very important; so, a viewing area at the front of the rack allows easy viewing of the label area of the beverage container. Unfortunately, in many instances where beverages are displayed in racks, especially where the beverage containers are suspended by their necks, the beverage containers are not always perfectly aligned with the labels facing forward for easy viewing because of the time required to align them and because rack stockers are generally not that attentive. In addition, even when initially perfectly aligned, they are subject to disturbance as consumers remove containers from the display. Accordingly, it will be appreciated that it would be highly desirable to have a display system that aligns the beverage label so that container labels face forward and prevents disturbance as containers are removed.

SUMMARY OF THE INVENTION

The prevent invention is directed to overcoming one or more of th problems set forth above. Briefly summarized, according to one aspect of the invention, a merchandising system for displaying and orienting beverage bottles comprises a plurality of beverage bottles each having a body with a product identification panel, a shoulder atop the body, a neck, a protruding flange about the neck, and a head atop the neck. A cap is attached to the head. The cap has a lower portion engaging the head and an upper portion with a protrusion extending above the head. The protrusion has side faces and a front face with the front face aligned vertically with the product identification panel. A display rack has at least one channel member. There are means on the channel member for receiving the plurality of beverage bottles, holding he plurality of beverage bottles by the protruding flange and dispensing the plurality of beverage bottles one at a time. The means includes a longitudinally extending slot in the channel and first and second keyway along the slot. The first keyway has a larger lateral dimension than the slot so that a neck flange can be inserted and removed through the keyway but cannot move laterally through the slot. The second keyway is adapted to receive the side faces of the protrusion of the cap so that the front face of the protrusion and the product identification panel face forward in the channel.

The present invention is a display rack and bottle with one defining a keyway and the other defining a key. When the key is in the keyway, the bottle label faces forward. Removing a bottle does not alter the relationship between the key and keyway ensuring that the bottle labels always face forward.

According to another aspect of the invention, a merchandising system for displaying and orienting beverage bottles comprises a plurality of beverage bottles each having a body with a product identification panel, a shoulder atop the body and a neck. A cap is attached to the head. The cap has a lower portion engaging the head and an upper portion defining a keyway and a front face. The front face is aligned vertically with the product identification panel. A display rack has at least one channel member and defines a key for engaging the keyway and holding the plurality of beverage bottles by the cap and dispensing the plurality of beverage bottles one at a time. The keyway is adapted to receive the key so that the product identification panel faces forward on the display rack.

In one adaptation, the key has a parallelepiped cross-section and the keyway has a parallelepiped opening. In another adaptation, the key has a circular cross-section and the keyway has a circular opening. When mated, the bottle is prevented from rotating so that the product label always faces forward.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
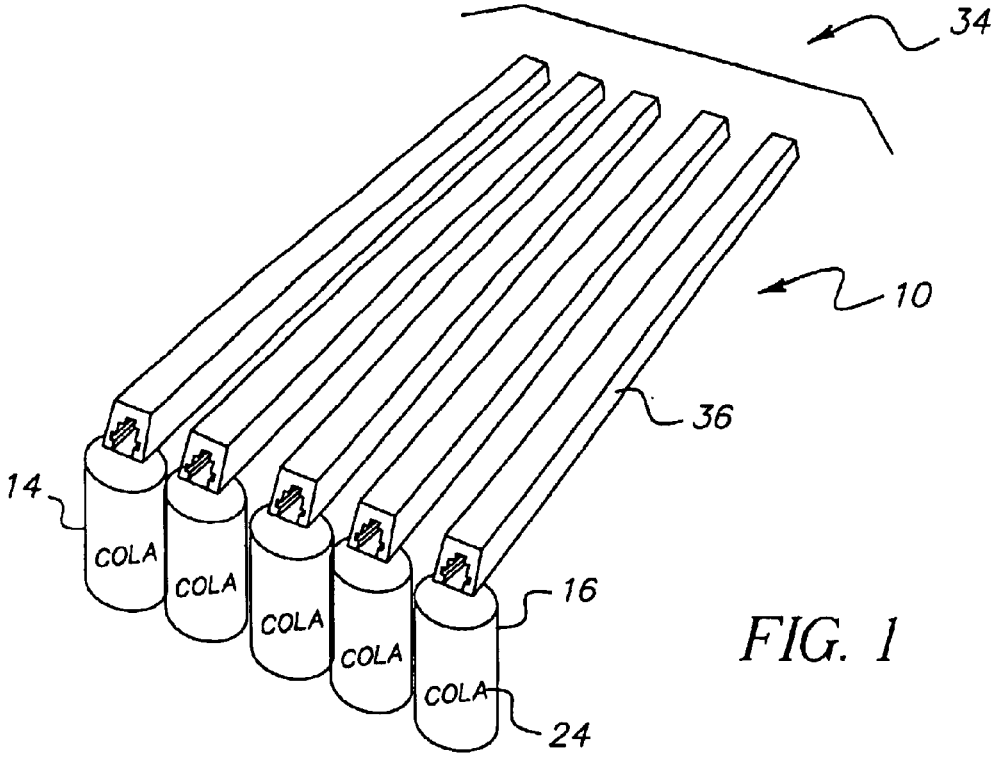
FIG. 1 is a perspective view of a preferred embodiment of a merchandising display device and bottle according to the present invention.
Figure 2:
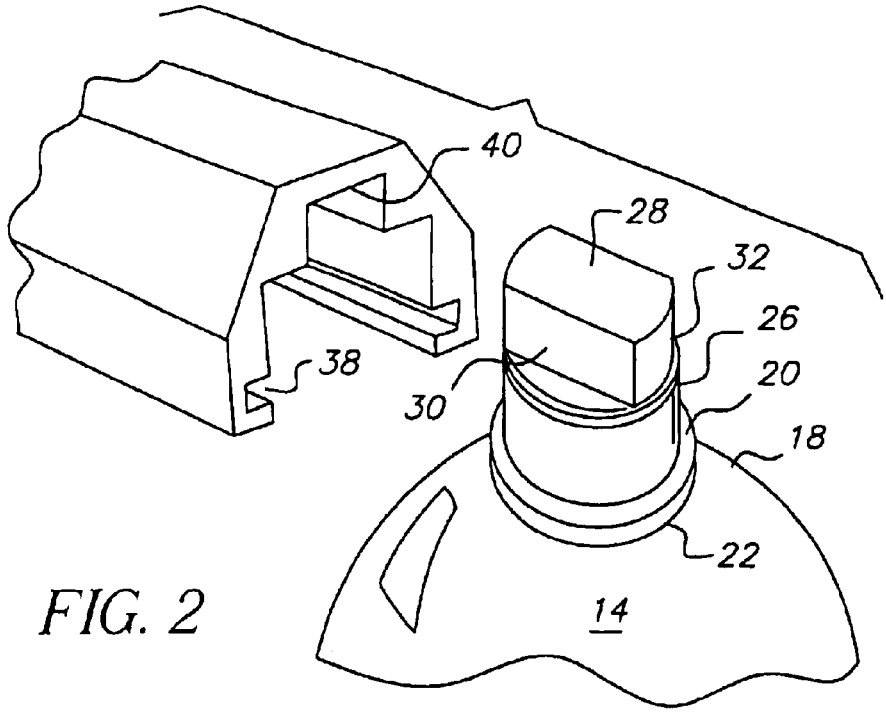
FIG. 2 is a fragmentary view of the device and bottle of FIG. 1 as the bottle is removed from the display device.

Referring to FIGS. 1–2, a merchandising system 10 includes a display track device 34 and a plurality of bottles 14. The merchandising system 10 displays and orients the beverage bottles 14 for dispensing one at a time. Each of the bottles 14 has a body 16, a shoulder 18 atop the body 16, a neck 20, a protruding flange 22 about the neck 20, and a head atop the neck 20. The body 16 has product identification panel 24 to which product labeling may be affixed. Preferably, there are two product identification panels spaced 180 degrees from one another about the circumference of the bottle 14.

A cap 26 is attached to the head and has a lower portion engaging the head and an upper portion with a protrusion 28 extending above the head. Protrusion 28 has parallel side faces 30 and a front face 32. Front face 32 is aligned vertically with the product identification panel 24.

A display rack 34 has at least one channel member 36 and preferably has a plurality of channel members. Means are provided on the channel member 36 for receiving the plurality of beverage bottles 14, holding the plurality of beverage bottles 14 by the protruding flanges 22 and dispensing the plurality of beverage bottles 14 one at a time. The means includes a longitudinally extending slot in the channel 36 and first and second keyways 38, 40 along the slot. The first keyway 38 has a larger lateral dimension than the slot so that a protruding flange 22 can be inserted and removed through the keyway 38 but can not move laterally through the slot. The second keyway 40 is adapted to receive the side faces 30 of the protrusion 28 of the cap 26 so that the front face 32 of the protrusion 28 and the product identification panel 24 face forward in the channel 36. By this construction, a channel is formed that has horizontal keyway 38 and a vertical keyway 40 above it. Horizontal keyway 38 supports the bottle by its neck ring or flange and limits horizontal movement of the bottle in the channel, while vertical keyway 40 forms guide groove for receiving the flat sides of the protrusion of the cap to prevent rotation of the cap and therefore the bottle attached to it.

Figure 3:
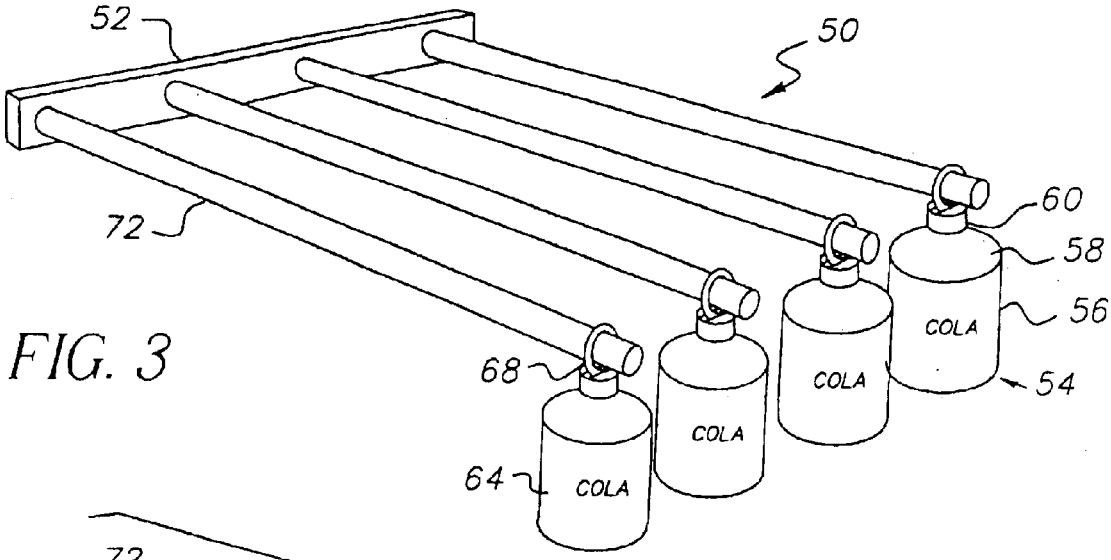
FIG. 3 is a perspective view of another preferred embodiment of a of a merchandising display device and bottle according to the present invention.
Figure 4:
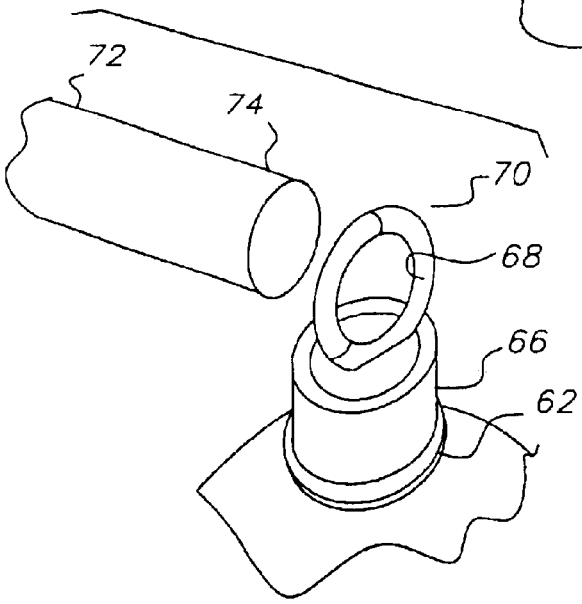
FIG. 4 is a fragmentary view of the device and bottle of FIG. 3 as the bottle is removed from the display device.
Figure 5:
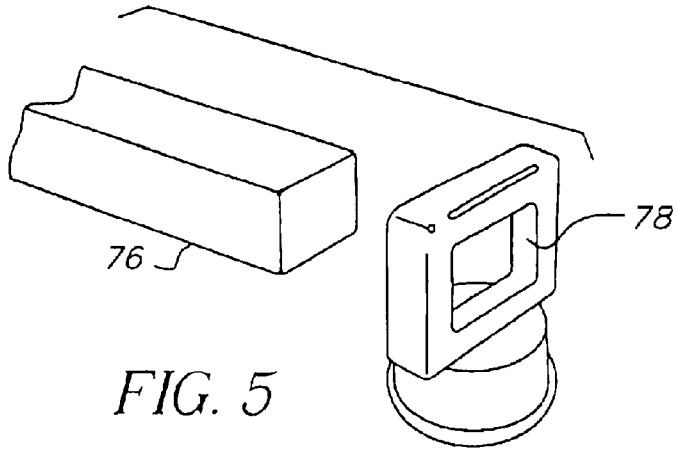
FIG. 5 is a fragmentary view similar to FIG. 4 but illustrating another preferred embodiment.

Referring to FIGS. 3–5, a merchandising system 50 includes a display rack device 52 and a plurality of bottles 54. The merchandising system 50 displays and orients the beverage bottles 54 for dispensing one at a time. Each of the bottles 54 has a body 56, a shoulder 58 atop the body 56, a neck 60, a protruding flange 62 about the neck 60, and a head atop the neck 60. The body 56 has product identification panel 64 to which product labeling may be affixed. Preferably, there are two product identification panels spaced 180 degrees from one another about the circumference of the bottle 54. A cap 66 is attached to the head and has a lower portion engaging the head and upper portion defining a keyway 68 and a front face 70. Front face 70 is vertically aligned with the product identification panel 64.

The display rack 52 has at least one elongated member 72 defining a key 74 for engaging the keyway 68 and holding the plurality of beverage bottles 54 by the cap 66 and dispensing the plurality of beverage bottles one at a time. The keyway 68 is adapted to receive the key 74 so that the product identification panel 64 faces forward on the display rack 52. Key 74 has a circular cross-section and keyway 68 has a circular opening.

FIG. 5 illustrates another preferred embodiment of a key 76 and keyway 78. Key 76 has a parallelepiped cross-section and the keyway 78 has a parallelepiped opening. The key and keyway may have any cross-sections that are mateable with one another to support the bottles for removal one at a time.

While the invention has been described with particular reference to the preferred embodiments, it will be understood by those skilled in the art that various changes may be made and equivalents may be substituted for elements of the preferred embodiments without departing from invention. For example, the channel members may be constructed of metal, plastic or a composite material. Also, the protrusion on the cap need not have flat sides but could have a cylindrical configuration.

As is evident from the foregoing description, certain aspects of the invention are not limited to the particular details of the examples illustrated, and it is therefore contemplated that other modifications and applications will occur to those skilled in the art. For instance, the keyway on the bottle for suspending the bottle need not be continuous, it could have a slit in its top to accommodate a hanging key suspended from above. It is accordingly intended that the claims shall cover all such modifications and applications as do not depart from the true spirit and scope of the invention.

What is claimed is:

1. A merchandising system for displaying and orienting beverage bottles, comprising:

a plurality of beverage bottles, each of said bottles having a body, a shoulder atop said body, a neck, a protruding flange about said neck, and a head atop said neck, said body having product identification panel;

a cap attached to said head, said cap having a lower portion engaging said head and an upper portion with a protrusion extending above said head, said protrusion having parallel side faces and a front face, said front face being aligned vertically with said product identification panel;

a display rack having at least one channel member; and means on said channel member for receiving said plurality of beverage bottles, holding said plurality of beverage bottles by said protruding flanges and dispersing said plurality of beverage bottles one at a time, said means including a longitudinally extending slot in said channel and first and second keyways along said slot, said first keyway having a larger lateral dimension than said slot so that a neck flange can be inserted and removed through said keyway but can not move laterally through said slot, said second keyway being adapted to receive said side faces of said protrusion of said cap so that said face of said protrusion and sad product identification panel face forward in said channel.

* * * * *